US006471629B1

(12) United States Patent
Gentile

(10) Patent No.: US 6,471,629 B1
(45) **Date of Patent: *Oct. 29, 2002**

(54) TOOLING FOR FORMING PACKAGING FROM UNITARY BLANKS

(76) Inventor: Aliseo Gentile, 8011 Schneider, Manchester, MI (US) 48158

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/204,943

(22) Filed: Dec. 3, 1998

Related U.S. Application Data

(60) Provisional application No. 60/067,453, filed on Dec. 4, 1997.

(51) Int. Cl.[7] ..... B31B 1/28

(52) U.S. Cl. ..... 493/175; 53/563; 229/104; 229/193; 493/167; 493/175; 493/218; 493/250; 493/936

(58) Field of Search ..... 493/250, 251, 493/252, 253, 167, 174, 175, 218, 936; 53/563; 229/104, 193

(56) References Cited

U.S. PATENT DOCUMENTS

| | | | | |
|---|---|---|---|---|
| 3,114,298 A | | 12/1963 | Boone | |
| 3,145,630 A | | 8/1964 | Moore | |
| 3,380,646 A | * | 4/1968 | Doyen et al. | 493/203 |
| 3,720,339 A | * | 3/1973 | Khetani | 215/1 C |
| 3,730,383 A | * | 5/1973 | Dunn et al. | 220/66 |
| 4,010,676 A | | 3/1977 | Eilenberg et al. | |
| 4,252,052 A | | 2/1981 | Meyers et al. | |
| 4,669,253 A | | 6/1987 | Shavit | |
| 5,312,035 A | | 5/1994 | Nold et al. | |
| 5,313,767 A | | 5/1994 | Gentile | |
| 5,356,069 A | * | 10/1994 | Bochet et al. | 493/252 |
| 5,411,203 A | * | 5/1995 | Bochet et al. | 493/252 |
| 5,452,844 A | * | 9/1995 | Bochet et al. | 493/252 |

FOREIGN PATENT DOCUMENTS

| | | |
|---|---|---|
| BE | 538036 | 5/1955 |

* cited by examiner

*Primary Examiner*—John Sipos
*Assistant Examiner*—Hemant M. Desai
(74) *Attorney, Agent, or Firm*—Brinks Hofer Gilson & Lione

(57) ABSTRACT

An apparatus for the formation of packaging from unitary blanks comprising a first tool having a convex end surface said convex end surface having edges that define a first center segment and a first plurality of triangular segments and a second tool having a concave end surface said concave end surface having edges that define a second center segment and a second plurality of triangular segments.

7 Claims, 5 Drawing Sheets

TOOLING FOR FORMING PACKAGING FROM UNITARY BLANKS

This application claims the benefit of Ser. No. 60/067,453, filed Dec. 4, 1997.

BACKGROUND OF THE INVENTION

The present invention relates to a device and method for forming packaging. More specifically the present invention relates to tooling and a method of using the tooling to mold small self-standing packaging containers or sachets from unitary generally rectangular cardboard blanks.

Small disposable packaging containers or sachets are commonly used to provide consumer samples for assorted products, especially for fluidic products. The unitary blanks used to form the sachets are laminated with a moisture proof coating and, when molded, form a completely sealed and sterile environment. The sample products include lotions, perfumes, food products and other consumer goods which would benefit from small sealed unitary packaging. High quality cosmetics are marketed through the use of sachets emblazoned with trademarks and configured for particular trade dresses. Self standing sachets are used in the hotel and restaurant industry to provide consumer products in bathroom facilities, eliminating the need for storage baskets or the like. There is an ongoing need in the art to provide improved tooling for forming sachets in appealing self-standing shapes.

Various apparatus have been developed for the formation of packaging containers from unitary blanks. The previous apparatus contain sharp corners and edges which might damage unitary blanks during the forming of packaging containers or sachets. These previous apparatus formed sachets that rely on sharp folds and corners for support points and had difficulty forming curved or bowed support surfaces from unitary blanks. The present invention has been fashioned with rounded edges and curved surfaces to better form curved or bowed surfaces from unitary blanks. The curved surfaces of the present invention decrease the chances of puncturing unitary blanks and create more possibilities for the configuration of unitary blanks. The present invention may more easily form curved surfaces and integrate these surfaces with sharply angled surfaces to create containers that were previously very troublesome to form.

SUMMARY OF THE INVENTION

The present invention involves the use of tooling with curved surfaces and rounded edges to form packages or sachets from unitary generally rectangular cardboard blanks. An object of the present invention is to decrease the incidence of damaged packaging due to the sharp edges used on previous tooling. Another object of the invention is to increase the number of packaging shapes possible by forming curved surfaces in packaging containers fashioned from the unitary blanks.

DETAILED DESCRIPTION OF THE PREFERRED EMBODIMENT

Figure 1:
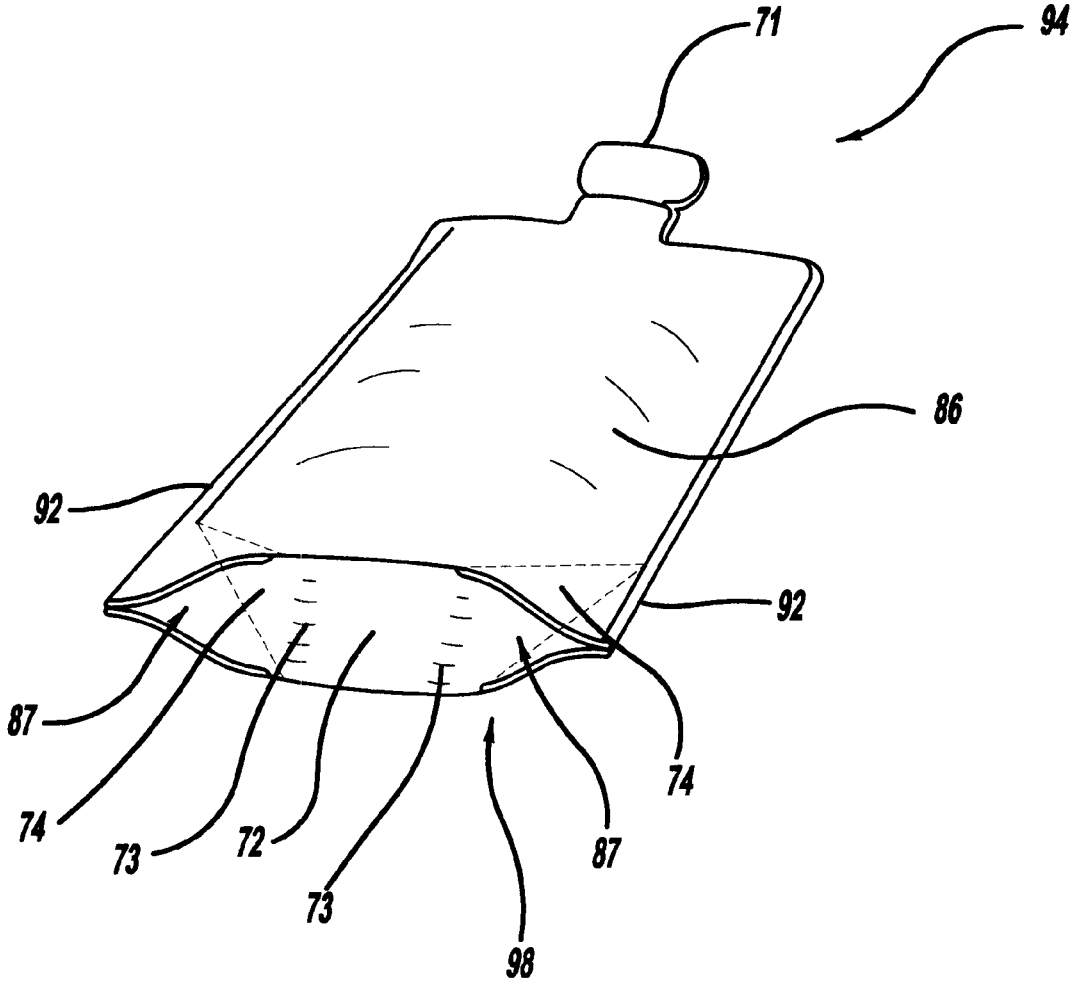
FIG. 1 is a front bottom perspective of a sachet formed by the tooling of the present invention.
Figure 4:
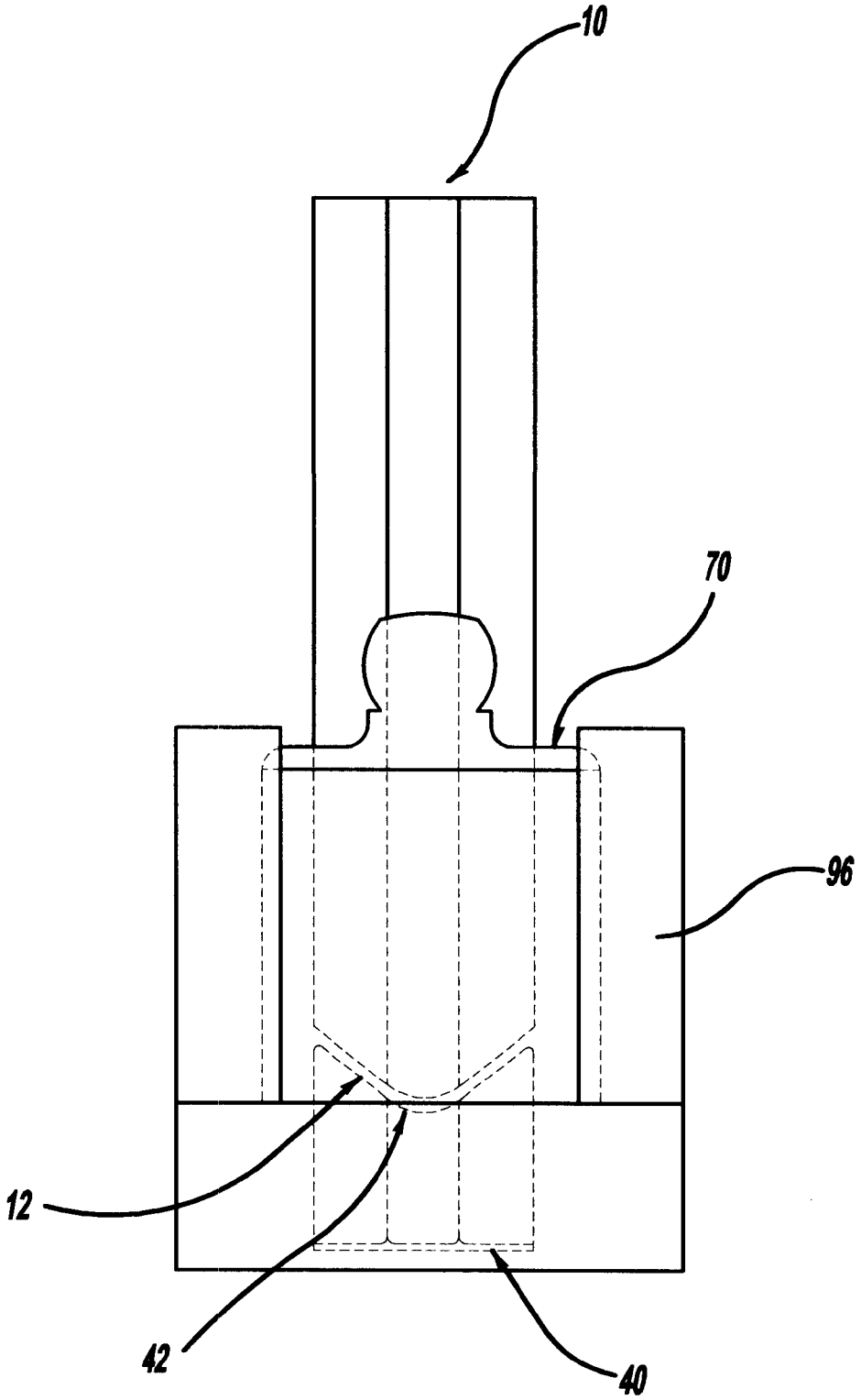
FIG. 4 is an elevation view showing the formation of a package by the complementary mandrels of the present invention.

FIG. 1 is a bottom perspective view of the finished molded package or sachet 94 created by the improved tooling of the present invention and illustrates the base configuration 98. As can be seen by FIG. 1, the sachet base 98 assumes the general configuration of the forming surfaces 12 and 42 integral to mandrels 10 and 40, shown in FIGS. 2A–2F, from which it was formed. End triangular segments 74 are shown curving inwardly into the sachet structure from center segment 72 to create recesses 87. There is no exact line of delineation or border between triangular segments 74 and center segment 72, but rather a gradual succession as shown by curved edges 73. The curved edges 73 and gradual slope between triangular segments 74 and center segment 72 resist puncturing caused by previous tooling, as no abrupt fold or crease is created. The curved edges 73 also allow the sachet 94 to stand erect upon on its center segment 72 while being supported at opposite ends by the bottom of sealed side seams 92 created by the fusing of package sides 86 during the forming process, as shown in FIG. 4.

Figure 2A:
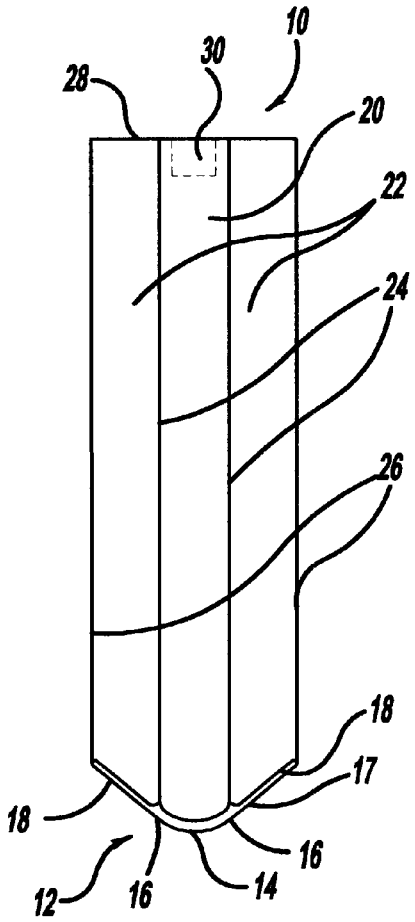
FIG. 2 is a front elevation view of the first mandrel of the present invention.
FIG. 2B is a front elevation view of the second mandrel of the present invention.
FIG. 2C is a side elevation view of the first mandrel of the present invention.
FIG. 2D is a side elevation of the second mandrel of the present invention.
FIG. 2E is bottom view of the first mandrel of the present invention.
FIG. 2F is a top view of the second mandrel of the present invention.

FIG. 2A is a front elevation view of the first mandrel of the present invention generally shown as 10. The mandrel 10 has a forming surface 12 that is convex in shape and located on its bottom end. The forming surface 12 is hemmed by a rounded perimeter edge 17 which defines the general exterior outline of the forming surface 12. A center segment 14 is bowed outward and defined by rounded edges 16. Bordering the center segment 14 are two triangular segments 18 that slope upward from the center segment 14 to complete the forming surface 12 of the first mandrel 10. The rounded edges 16 created a gradual succession between the center segment 14 and the triangular segments 18.

The lengthwise sides of the first mandrel 10, as shown in FIG. 2A, have flat parallel center sections 20 defined by generally straight longitudinal edges 24 which extend for substantially the length of the first mandrel 10. Angled side sections 22 abut flat parallel sections 20 and converge to generally straight longitudinal end edges 26. This convergence of angled side sections 22 is consistent with the shape of the triangular segments 18 located on the forming surface 12 which defines the bottom ends of the angled side sections 22. A bore 30 is located on the top end 28 of the first mandrel 10 and is used for mounting the mandrel 10 to a positioning device such as a cylinder shaft, gear box shaft, solenoid shaft, motor shaft and other actuation devices known to persons of ordinary skill in the art.

Figure 2C:
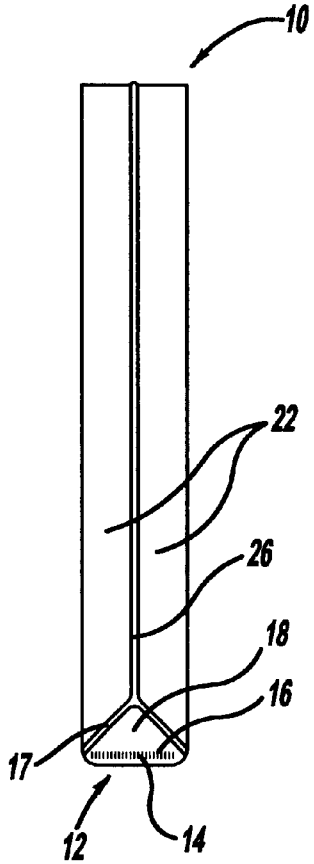
Figure 2B:
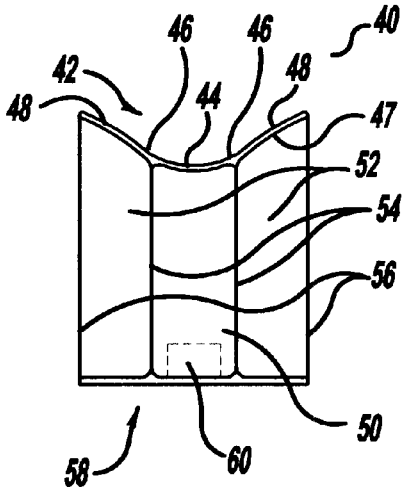

The complementary or second mandrel is shown in FIG. 2B generally as 40. The mandrel 40 has a forming surface 42 that is concave in shape and located on its top end. The forming surface 42 is bordered by a rounded perimeter edge 47 which defines the general exterior outline of the forming surface 42. A center segment 44 is bowed inward and defined by rounded edges 46. Bordering the center segment 44 are two triangular segments 48 that slope upward from the center segment 44 to complete the forming surface 42 of the second mandrel 40. As in the first mandrel 10, the rounded edges 46 created a gradual succession between the center segment 44 and the triangular segments 48.

The lengthwise sides of the second mandrel 40, as shown in FIG. 2B, have flat parallel center sections 50 defined by generally straight longitudinal edges 54 which extend for substantially the length of the first mandrel 40, and are similar to generally straight longitudinal edges 24 of the first mandrel 10. Angled side sections 52, similarly to angled side sections 22 of the first mandrel 10, abut flat parallel sections 50 and converge to generally straight longitudinal end edges 56. This convergence of angled side sections 52 is consistent with the shape of the triangular segments 48 located on the forming surface 42 which defines the top end of the angled side sections 52. A bore 60 is located on the bottom end 58 of the second mandrel 40 and is used for mounting the mandrel 40 in a similar manner as mandrel 10.

The forming surface 42 of the second mandrel 40 is fashioned to be complementary to the forming surface 12 of the first mandrel 10, as shown in FIGS. 2A–2F. When forming surface 12 and forming surface 42 are brought together, both surfaces should substantially adjoin throughout. This complementary function allows unitary blanks, when placed between the forming surfaces 12 and 42, to be generally supported throughout on the areas which contact the forming surfaces 12 and 42. By supporting the unitary blanks on both sides the final shape of the sachet is better determined and the occurrence of puncturing is decreased.

Figure 2D:
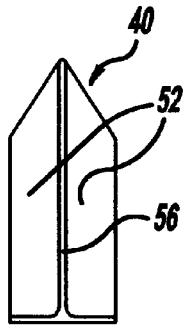

FIG. 2C is a side elevation view of the first mandrel 10 and helps to better illustrate how the angled side sections 22 converge to longitudinal end edges 26. Triangular sections 18 generally assume the planar cross section of angled side sections 22 at the forming surface 12 located at the bottom end of the first mandrel 10. Bowed center segment 14 curves to rounded edges 16 which faintly define one side of the triangular sections 18. FIG. 2D is a side elevation view of the complementary or second mandrel 40 and, similar to FIG. 2C, shows angled side sections 52 converging to longitudinal end edges 56.

Figure 2E:
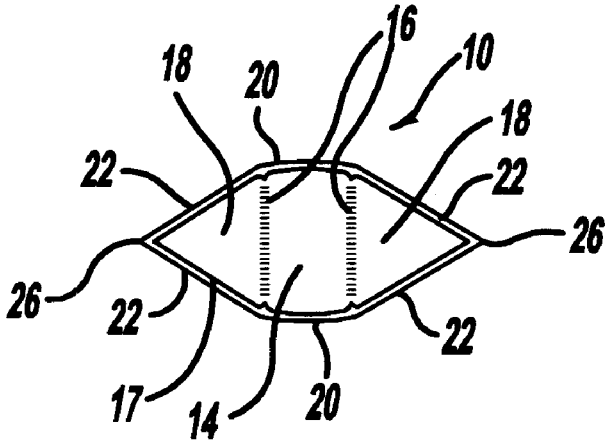

FIG. 2E is a bottom view of the first mandrel 10. In this view the horizontal planar features of the forming surface 12 are better illustrated. The center segment 14 is located between triangular segments 18 and bordered by rounded edges 16. Longitudinal end edges 26 are shown at the vertexes of triangular segments 18 as angled side sections 22 converge outwardly from flat parallel center sections 20.

Figure 2F:
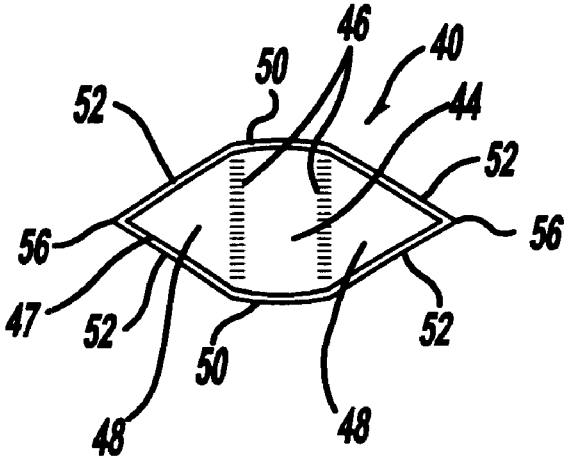

FIG. 2F is a top view of the second mandrel 40. In this view, similar to FIG. 2E, the horizontal planar features of the forming surface 42 are better illustrated. The center segment 44 is located between triangular segments 48 and bordered by rounded edges 46. The center segment 44 and rounded edges 46 differ slightly from the rounded edges 16 of the first mandrel, as the arc of the center segment 44 and rounded edges 46 extend inwardly to the second mandrel 40 in a concave fashion. The degree of curvature for the rounded edges 46 is also less than the degree of curvature for the rounded edges 16. Longitudinal end edges 56 are shown at the vertexes of triangular segments 48 as angled side sections 52 converge outwardly from flat parallel center sections 50.

Figure 3:
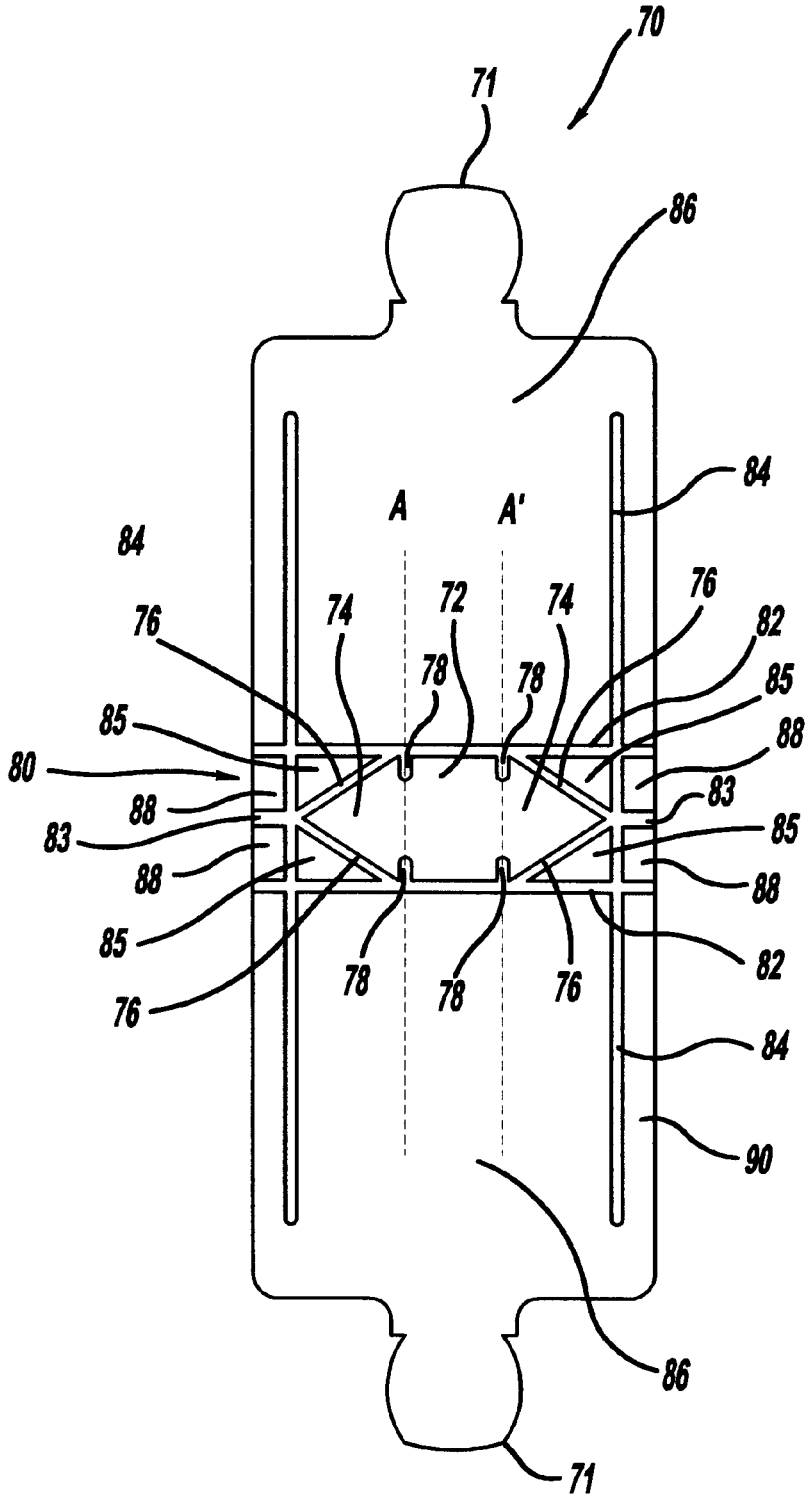
FIG. 3 is a top view of one embodiment of the unitary blank used in the present invention.

FIG. 3 is a top view of one embodiment of the unitary blanks 70 used to form the packages or sachets of the present invention. The unitary blank 70 may be composed of a relatively rigid sheet of paper coated or otherwise covered with a thermoplastic material. In other embodiments a suitable substantially thermoplastic or metallic unitary blank may also be used. Unitary blank 70 is generally rectangular in form with integral cap segments 71 located on either end. At the center of the unitary blank 70 is a bottom segment 80, defined by parallel creases 82, from which the final molded container will stand upright upon. The center segment 72 is located in this bottom segment 80. Bordering the center segment 72 are triangular segments 74. There is no exact line of delineation or border between triangular segments 74 and center segment 72, but rather a gradual succession. When the bottom 80 is fully formed the triangular segments 74 will slope upward from the center segment 72. Finger creases 78 are positioned along lines A and A'. When the forming surfaces 12 and 42 sandwich the unitary blank, these finger creases 78 will create a curving point along lines A and A' to allow the center segment 72 to gradually curve upward to triangular segments 74. Opposing end triangle segments 85 will become upright and opposing end rectangular segments 88 will become upright and make contact with their opposite rectangular segments 88.

The formation of the container takes place when the two mandrels are brought together and sandwich the unitary blank 70, as shown in FIG. 4, by a package forming and filling machine. Such a machine is disclosed within the following U.S. Pat. No. , 5,313,767 entitled "Multiple Package Forming and Filling Machine" issued to Gentile on May 24, 1994 and is incorporated by reference herewithin. Referring to FIGS. 3 and 4, when the two opposing sides 86 of the unitary blank 70 are brought together by mandrels 10 and 40 in a forming die 96, the two opposing sides 86 will pivot upward about parallel creases 82, the triangular segments 74 will slope upward about finger creases 78 forming recesses, opposing end triangle segments 85 will become generally upright and opposing end rectangular segments 88 will become upright and make contact with their opposite rectangular segments 88. The die 96 will then heat and fold the blank unitary blank 70 along side creases 84 and, after the sachet is filled, close the top of the unitary blank 70 to seal the package in its molded form.

It is to be understood that the invention is not limited to the exact construction illustrated and described above, but that various changes and modifications may be made without departing from the spirit and scope of the invention as defined in the following claims.

I claim:

1. An apparatus for the formation of a self-standing packaging container from unitary blanks of a relatively rigid coated paper material having a generally rectangular form comprising:

a forming die having an internal cavity;

a first mandrel having a convex end surface, said convex end surface defining a first center segment having a convex shape and a pair of generally planar triangular segments sloping upward from said first center segment adjoining said center segment at rounded edges on opposite sides of said first center segment forming a first continuous curvilinear surface, said first mandrel having sides defined by a first pair of parallel center sections abutting a first pair of angled side sections adjoining said first parallel sections with said first pair of angled side sections joining at first longitudinal end edges; and a second mandrel having a concave end surface, said concave end surface defining a second center segment having a concave shape and a pair of generally planar triangular segments sloping upward from said second center segment adjoining said center segment at rounded edges on opposite sides of said second center segment forming a second continuous curvilinear surface, said second mandrel having sides defined by a second pair of parallel center sections abutting a second pair of angled side sections adjoining said second parallel sections at second longitudinal end edges, whereby said first mandrel and said second mandrel engage said unitary blanks such that said blank is compressed between said first mandrel end surface and said second mandrel end surface and cooperate with said die to force said unitary blanks into a generally upright position forming a continuous curvilinear bottom surface and, thereby, form said unitary blank into said packaging.

2. The apparatus of claim 1, wherein said convex end surface and said concave end surface are complementary, whereby when said convex end surface and said concave end surface are brought into contact with said blank, they form a substantially constant separation gap.

3. The apparatus of claim 1 wherein said straight longitudinal end edges are rounded.

4. The apparatus of claim 1 wherein said first mandrel and said second mandrel include a connection surface defining a bore.

5. The apparatus of claim 1, wherein said unitary blank is comprised of a substantially rectangular sheet of cardboard having a heat sealable coating.

6. The apparatus of claim 5, wherein said unitary blank further comprises an integral cap.

7. The apparatus of claim 6, wherein said unitary blank further comprises:

a first set of creases which define a segment delineating the bottom of said unitary blank;

a second set of creases within said bottom which define triangular segments;

a third set of creases which define end rectangular segments that abut said triangular segments; and wherein said unitary blank is designed to be sandwiched between said first and second mandrel and folded along said creases to create a stable bottom section, whereby said packaging can stand upright.

* * * * *